US009339698B2

(12) United States Patent
Zhang et al.

(10) Patent No.: US 9,339,698 B2
(45) Date of Patent: May 17, 2016

(54) TENNIS BAG WITH BALL RETRIEVING AND DISPENSING UNIT

(71) Applicants: Tiffany Tong Zhang, Bellevue, WA (US); Ching Qing Guo, Bellevue, WA (US)

(72) Inventors: Tiffany Tong Zhang, Bellevue, WA (US); Ching Qing Guo, Bellevue, WA (US)

( * ) Notice: Subject to any disclaimer, the term of this patent is extended or adjusted under 35 U.S.C. 154(b) by 446 days.

(21) Appl. No.: 13/923,380

(22) Filed: Jun. 21, 2013

(65) Prior Publication Data

US 2014/0374456 A1 Dec. 25, 2014

(51) Int. Cl.

| | |
|---|---|
| ***A63B 47/02*** | (2006.01) |
| ***A45C 3/00*** | (2006.01) |
| ***A63B 71/00*** | (2006.01) |
| ***A63B 47/00*** | (2006.01) |

(52) U.S. Cl.

CPC . *A63B 47/02* (2013.01); *A45C 3/00* (2013.01); *A63B 47/00* (2013.01); *A63B 71/0045* (2013.01); *A45C 2003/007* (2013.01); *A63B 2102/02* (2015.10); *A63B 2225/093* (2013.01); *A63B 2243/0083* (2013.01); *Y10S 224/919* (2013.01)

(58) Field of Classification Search

CPC ..... A45F 3/02; A45F 3/04; A63B 47/002; A63B 47/02; A63B 71/0056; A63B 47/00; A63B 2243/0083; A63B 2225/093; A63B 2102/02; A45C 3/00; A45C 2003/007

USPC ..... 224/919, 251, 645, 653, 681, 236, 237; D3/216, 217; 221/185, 309

See application file for complete search history.

(56) References Cited

U.S. PATENT DOCUMENTS

| | | | | |
|---|---|---|---|---|
| 3,804,449 | A * | 4/1974 | Falitz | A63B 47/021 294/19.2 |
| 3,889,996 | A * | 6/1975 | Campbell | A63B 47/02 294/19.2 |
| 4,088,251 | A * | 5/1978 | Rodriguez | A63B 47/001 206/315.9 |
| 4,629,235 | A * | 12/1986 | Logue | A63B 47/02 221/306 |
| 4,798,319 | A * | 1/1989 | James, Jr. | A63B 47/001 224/196 |

(Continued)

*Primary Examiner* — Justin Larson
*Assistant Examiner* — Peter Helvey
(74) *Attorney, Agent, or Firm* — Chen-Chi Lin

(57) ABSTRACT

A portable tennis apparatus comprising a tennis bag, a tennis ball retrieving unit, a stretchable back bar and an extendable bottom stand. The ball retrieving unit retrieves balls on the ground directly to the bag; the stretchable back bar can be pulled up and pushed around with rolling means on the ground easily. The top opening of the bag made it easy to reach the balls for replay. The extendable stand can raise the tennis bag at a desirable level for dispensing balls so that the player does not have to bend down. The stretchable back bar and the stand can be put back to their original position during the transportation of the apparatus, such as between tennis court and player's home. The entire apparatus is light-weighted, easily carried and operated single-handed. This apparatus is truly an "all-in-one" tennis apparatus, and a revolution in the field of tennis equipment.

28 Claims, 13 Drawing Sheets

(56) References Cited

U.S. PATENT DOCUMENTS 5,040,675 A * 8/1991 Cleveland ..... A63B 47/00 206/315.9
5,086,948 A * 2/1992 Slusarz ..... A47F 1/082 221/185
5,634,680 A * 6/1997 Green ..... A63B 47/02 206/315.9
5,772,090 A * 6/1998 Rodriguez ..... A63B 47/00 206/315.9
5,826,746 A * 10/1998 Ash, Jr. ..... A45F 3/04 221/185
5,839,631 A * 11/1998 Hebert ..... A63B 47/00 206/315.9
5,951,075 A * 9/1999 Green ..... A63B 47/02 206/315.9
5,975,293 A * 11/1999 Fowler ..... A63B 71/0045 206/315.1
6,053,386 A * 4/2000 Reynolds ..... A63B 47/001 221/185
6,142,544 A * 11/2000 Benzoni ..... A63B 47/02 280/47.18
8,328,254 B1 * 12/2012 Zats ..... A63B 47/02 294/19.2
2006/0151561 A1 * 7/2006 Quinn ..... B63B 35/7946 224/652
2007/0017948 A1 * 1/2007 Smithson ..... A45C 3/00 224/663
2008/0149508 A1 * 6/2008 Campbell ..... A63B 55/20 206/315.1
2010/0108731 A1 * 5/2010 Rowe ..... A45F 3/042 224/654
2011/0010818 A1 * 1/2011 Hood ..... A41D 27/20 2/102
2012/0273540 A1 * 11/2012 Preston ..... A45F 3/04 224/576
2013/0037591 A1 * 2/2013 Ostenbridge ..... A45C 3/00 224/607

* cited by examiner

TENNIS BAG WITH BALL RETRIEVING AND DISPENSING UNIT

RELATED APPLICATIONS

The present application is a continuation-in-part application of U.S. provisional patent application, Ser. No. 61/663,630, filed Jun. 25, 2012, for TENNIS BAG AND BALL PICKUP UNIT, by Tiffany Tong Zhang, Ching Qing Guo, included by reference herein and for which benefit of the priority date is hereby claimed.

FIELD OF THE INVENTION

The present invention relates to a portable tennis apparatus and, more particularly, to a portable tennis bag that is also a tennis ball retrieving and dispensing device.

BACKGROUND OF THE INVENTION

To play a tennis game, the players must at least use a ball container, such as a tennis bag, to transport the balls to and from a tennis court. During a tennis game, tennis balls are often widely scattered on the ground in a court or field. Without a ball retrieving and dispensing device, one must frequently bend down and stand up to pick up the balls from the ground and to serve the balls. This action consumes the player considerably more energy in addition to game playing, it also tends to cause back strain and back pain. The player may also need a handy container to carry all the balls.

The tennis bags and ball retrieving devices of prior art are separate apparatus. The tennis bags of prior art are either hand-held or carried over shoulders, which can be quite heavy if containing large number of balls. The tennis ball retrieving devices of prior art, are either with small capacity (only contains a few balls), or space-occupying large and heavy equipment. Some of the basket type of ball retrieving devices of prior art do have the capacity of reversing the top handles to increase the height of the basket for ball dispensing, but they are all "one-height-fit-all" type, especially the tall players still need to bend down to pick out the balls. One also needs to lift and carry the heavy basket off ground between scattered balls on the tennis court. Sometimes one needs to transfer the balls from a retrieving device to a ball dispensing device, which can be time-consuming and tiring.

PRIOR ART

TENNIS BALL RETRIEVING MACHINES, which are large, complex and expensive, not suitable for personal use, such as:

Tennis ball vacuum collector patented by Mailman in 2012, U.S. Pat. No. 8,313,396B1

Tennis practice machine patented by Phillip A Torbet in 1977, U.S. Pat. No. 4,021,037A.

Ball retrieval device patented by Edward B Frankel 1992, U.S. Pat. No. 5,147,100.

Tennis ball retriever patented by Kurt G Beranek in 1995, U.S. Pat. No. 5,407,242.

Tennis ball retrieving device by John Meyer in 1978, U.S. Pat. No. 4,077,533.

Tennis ball retriever with hinged gate by Leonard Falitz et al. in 1975, U.S. Pat. No. 3,902,749.

Portable ball retriever, holder and carrier apparatus by Dennis K Stotts in 1988, U.S. Pat. No. 4,735,544.

Tennis ball receptacle and dispenser by Bill Richter in 1990, U.S. Pat. No. 4,978,041.

BASKET TYPE OF TENNIS BALL RETRIEVERS, which are rigid in shape, space-occupying, heavy to carry by hand, such as:

Portable ball retriever patented by Zats in 2012, U.S. Pat. No. 8,328,254B1.

Ball retrieving apparatus patented by Gwin and Pearson in 2011 U.S. Pat. No. 8,075,030B2, which also has very small capacity of a few balls.

Other wire basket with handles were patented by Stap in 1968 (U.S. Pat. No. 3,371,950), Seewagen and Markisz in 1974 U.S. Pat. No. 3,820,836), Madrazo in 1995 (U.S. Pat. No. 5,464,262), Podejko in 2002 (U.S. Pat. No. 6,354,643), and Nestable basket type of ball retrieval and storage device by Christina E Turdo in 2012, U.S. Pat. No. 8,141,919, Ball picker dolly by Lynn L Ray in 1983, U.S. Pat. No. 4,383,695.

TUBE TYPE OF TENNIS BALL RETRIEVERS, which have very limited capacity of just a few balls, such as:

Ball delivery retrieval and storage system by Kenneth W Loerop et al, in 2001, U.S. Pat. No. D442658.

Tennis ball retrieval, storage and dispensing device by Jonathan C Shoham in 2011, U.S. Pat. No. 7,922,608.

Ball retrieval, storage and discharge device by Ryan L Nelson in 1998, U.S. Pat. No. 5,775,751.

SUMMARY OF THE INVENTION

In accordance with the present invention, there is provided a portable device and method for transporting and retrieving tennis balls easily and quickly. More particularly, the invention is a device that includes a tennis bag, a tennis ball retrieving unit, a stretchable back handle with an end hand-grip, and a rolling mean, and a bag stand. The invention is truly an "all-in-one" and handy tennis apparatus. The ball retrieving unit retries balls quickly and easily from the ground directly into the tennis bag; the flexible and compressible bag makes it very easy to carry and transport large or small number of balls; the top opening of the bag provides easy access to pick out balls from the bag for replay. The hand-grip and the stretchable back bar can be pulled up and pushed the unit with rolling means on the ground in any direction easily. The extendable stand with adjustable height can raise the tennis bag at a desirable level, according to the player's height, for dispensing balls so that the player does not have to bend down to pick the balls. The stretchable back bar and the stand can be put back to their original position during the transportation of the apparatus, such as between tennis court and player's home. The entire apparatus is light-weight and easily carry-on and operated single-handed.

It is an object of the invention to provide a tennis apparatus.

It is an object of the invention to provide a tennis apparatus for storing and transporting tennis balls; retrieving and dispensing tennis balls during game play.

It is a further object of the invention to provide a convenient carry-on tennis bag which is also a tennis ball retrieving device and a tennis ball dispensing device.

It is an object of the invention to provide a tennis bag that has the feature of conventional sports bag and pull-up traveling suitcase such as stretchable handle and rolling wheels.

It is an object of the invention to provide a core mean of ball retrieving unit comprised of stretchable back bar, the side-stick and the bottom retrieving grid.

It is an object, of the invention to provide an end hand-grip that gear the direction of the device and to deliver the pressure or energy for ball retrieval.

It is an object of the invention to provide an adjustable stand that raises the top opening of the tennis bag to a desirable level, such as to player's waistline, so that the player of different height can easily reach into the tennis bag, without bending down, to pickout a ball for replay.

It is an object of the invention to provide a locking system on the bag stand to prevent the shifting of the level of the bag.

It is an object of the invention to provide light-weighted bag which is compressible with small number of balls, and expandable with large number of balls.

It is an object of the invention to provide a tennis apparatus that can be carried on and operated with just one hand.

It is an object of the invention to provide options of adding more pockets to the bag for personal accessories, such as keys, cell phone and water bottles and etc.

It is an object of the invention to provide option of a side hook or loop to hold a tennis racket.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
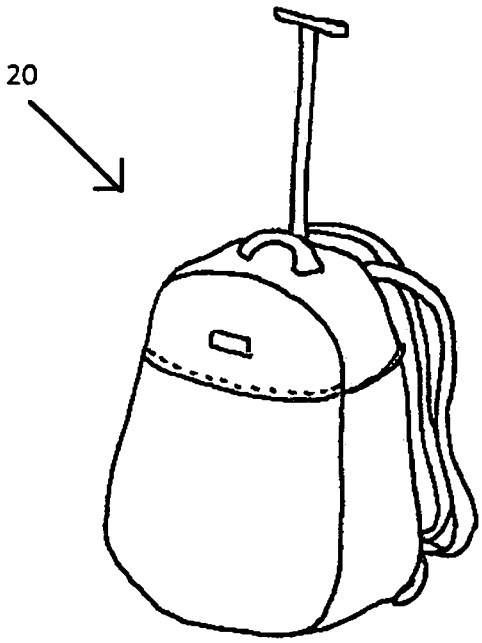
FIG. 1 is a perspective view of a tennis bag with tennis ball retrieving and dispensing unit in accordance with the present invention.

FIG. 1 is a perspective view of the Tennis bag 20 with tennis ball 16 retrieving unit in accordance with the present invention.

Figure 2:
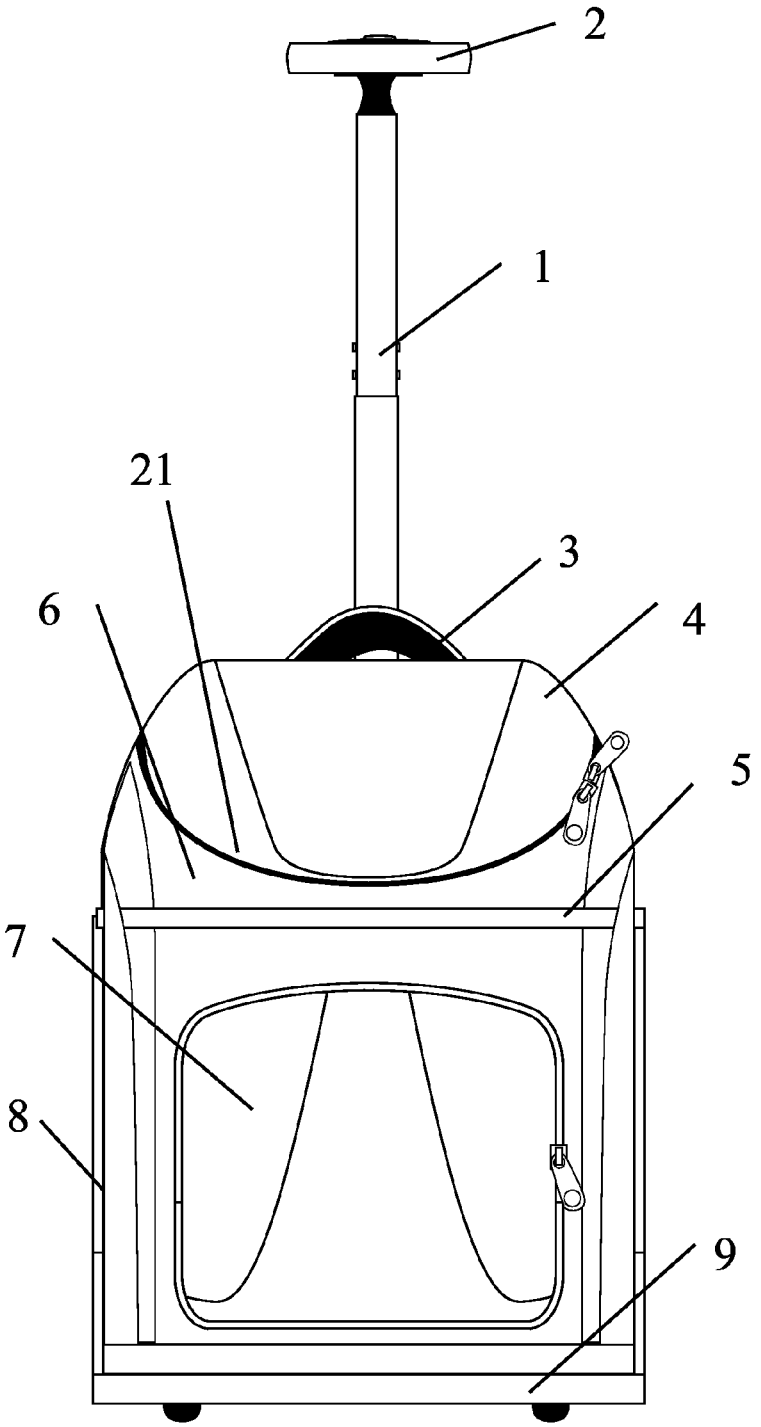
FIG. 2 is a front perspective view of the tennis bag with tennis ball retrieving and dispensing unit in FIG. 1.

FIG. 2 is a front perspective view of the tennis bag 20 with tennis ball 16 retrieving unit in FIG. 1.

Figure 3:
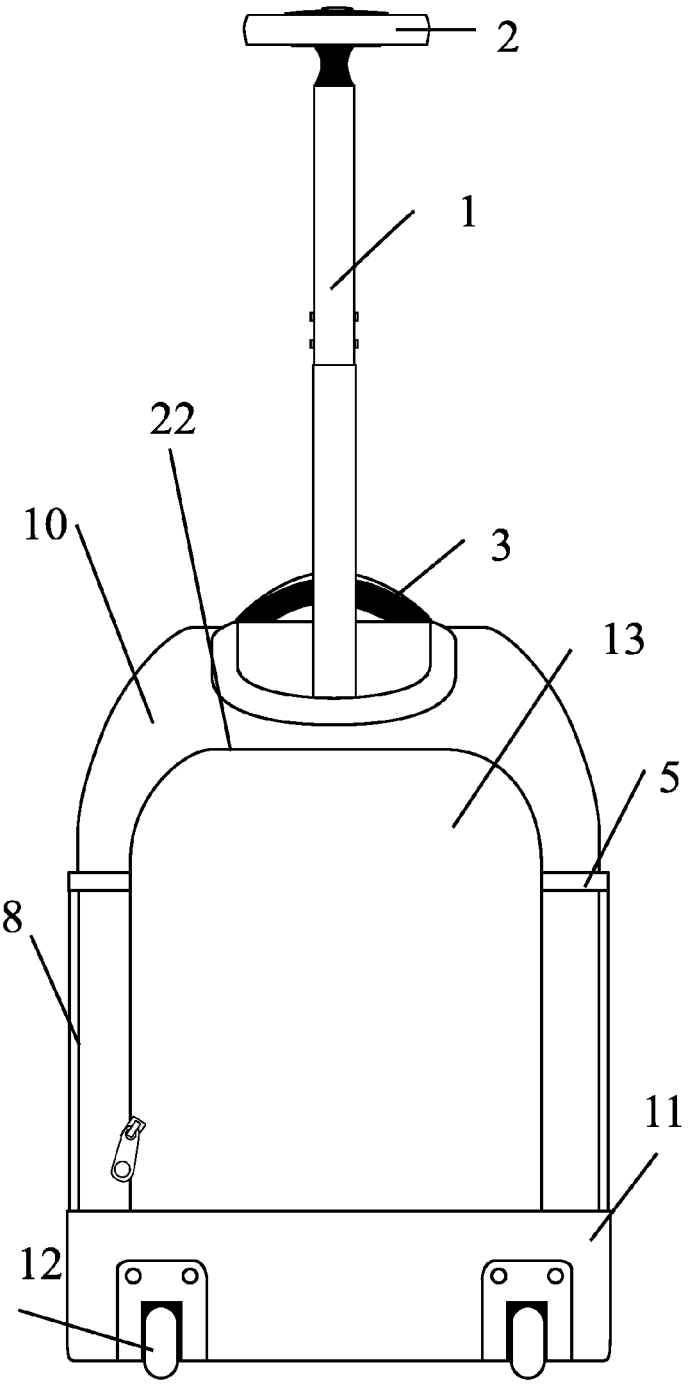
FIG. 3 is a rear perspective view of the tennis bag with tennis ball retrieving and dispensing unit in FIG. 1.

FIG. 3 is a rear perspective view of the tennis bag 20 with tennis ball 16 retrieving unit in FIG. 1.

Figure 4:
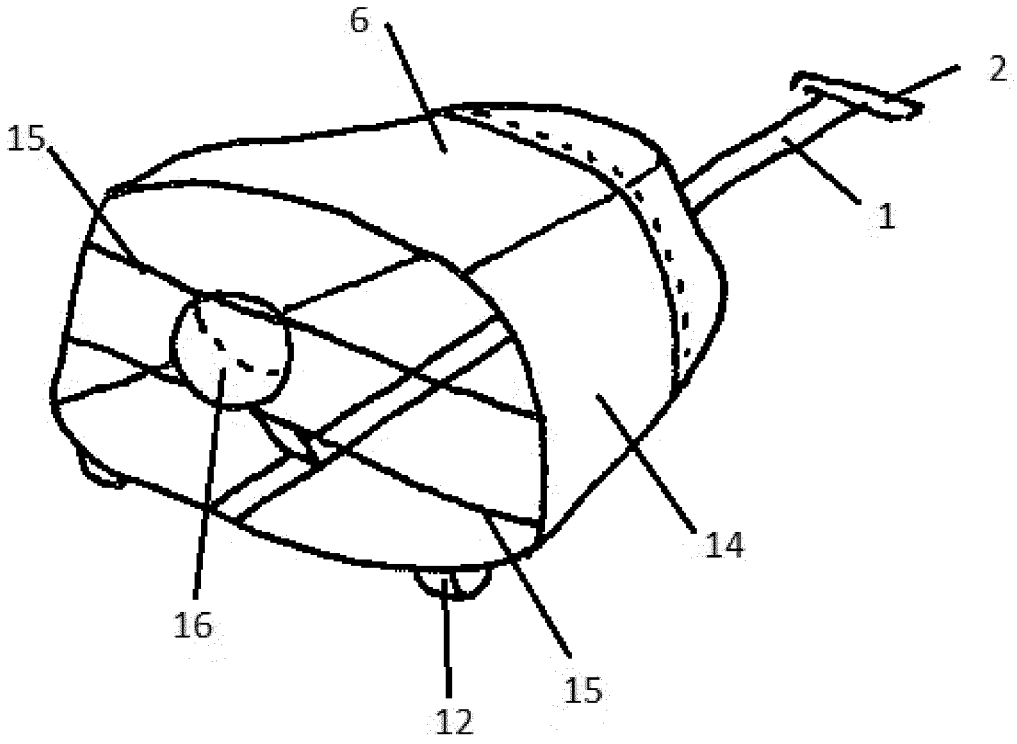
FIG. 4 is a bottom exploded view of a tennis bag with tennis ball retrieving and dispensing unit in FIG. 1.

FIG. 4 is a bottom exploded view of the tennis bag 20 with tennis ball 16 retrieving unit in FIG. 1.

Figure 5:
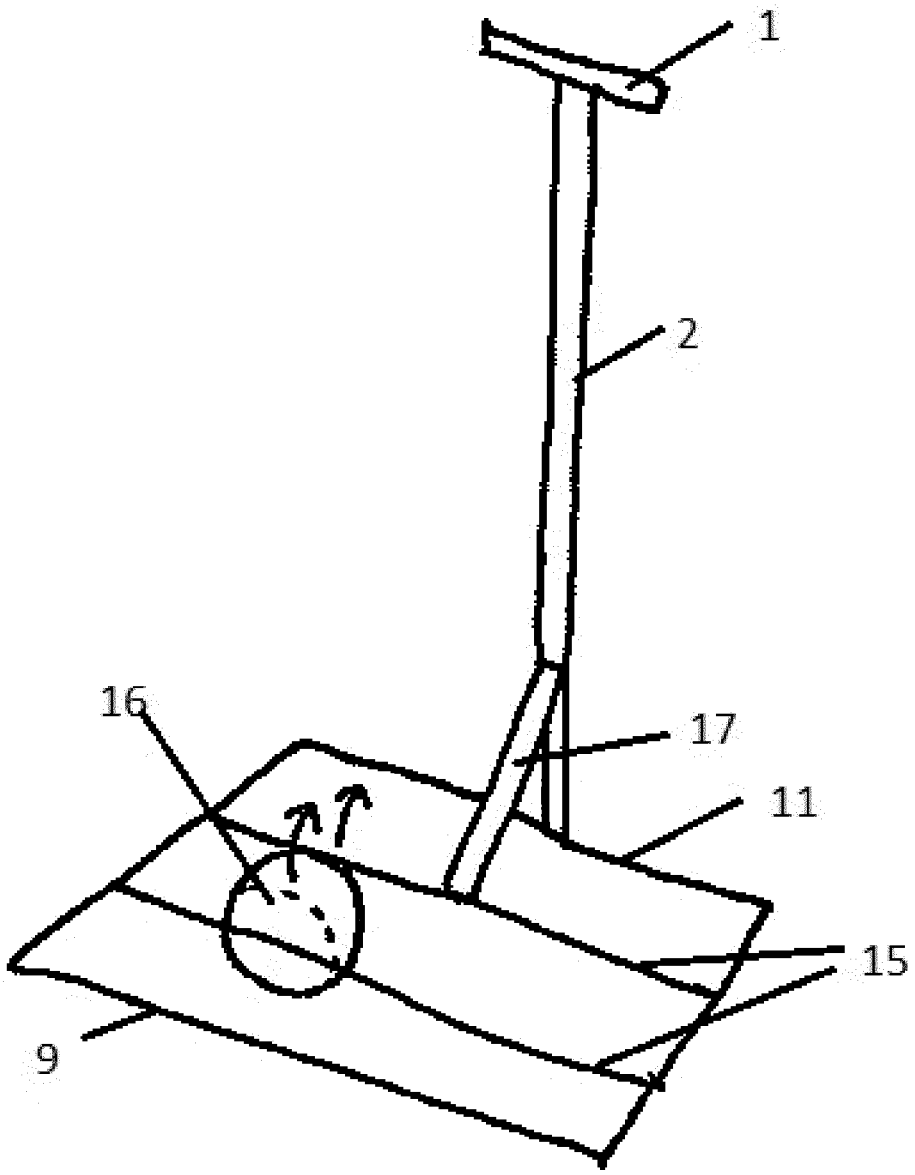
FIG. 5 is a top perspective view of the tennis ball retrieving frame of the tennis bag with tennis ball retrieving and dispensing unit in FIG. 1.

FIG. 5 is a top perspective view of the tennis ball 16 retrieving frame of the tennis bag 20 with tennis ball 16 retrieving unit in FIG. 1.

Figure 6:
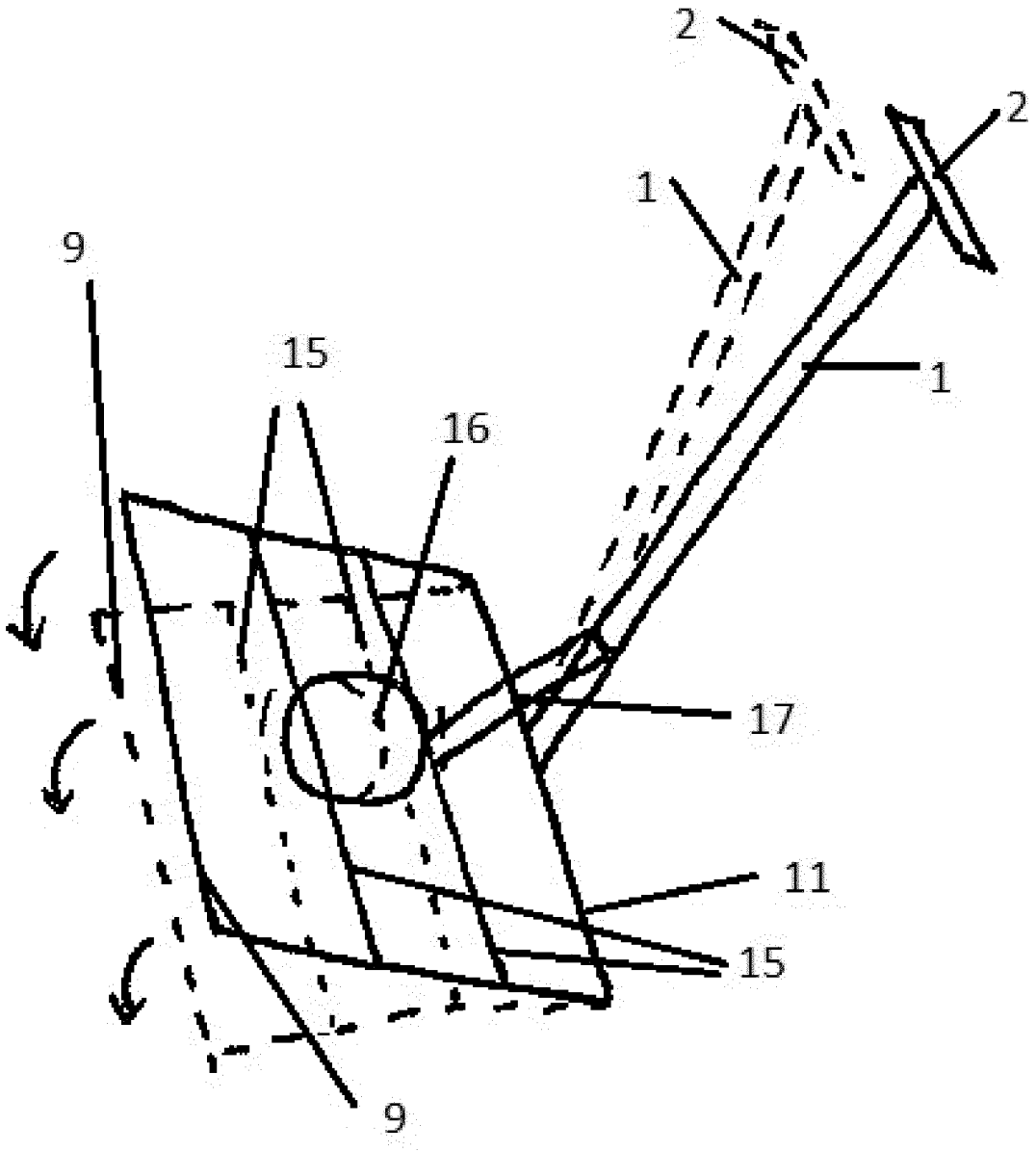
FIG. 6 is a top exploded view of the tennis ball retrieving frame, while in use, of the tennis bag with tennis retrieving and dispensing unit in FIG. 1.

FIG. 6 is a top exploded view of the tennis ball 16 retrieving frame, while in use, of the tennis bag 20 with tennis retrieving unit in FIG. 1.

Figure 7:
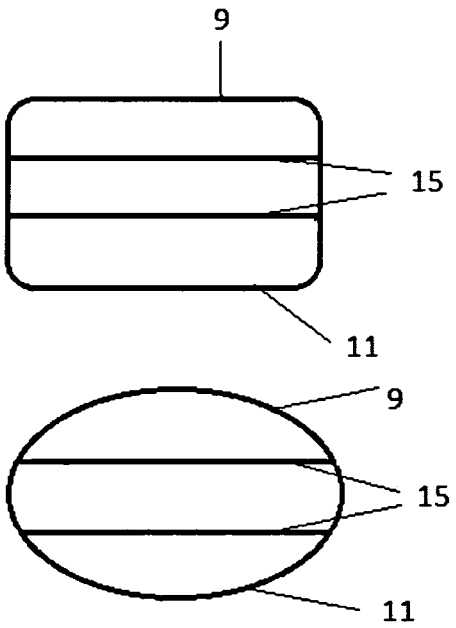
FIG. 7 is a bottom plan view of the bottom tennis ball retrieving panel of the tennis bag with tennis ball retrieving and dispensing unit in FIG. 1.

FIG. 7 is a bottom plan view of the bottom tennis ball 16 retrieving panel of the tennis bag 20 with tennis ball 16 retrieving unit in FIG. 1.

Figure 8:
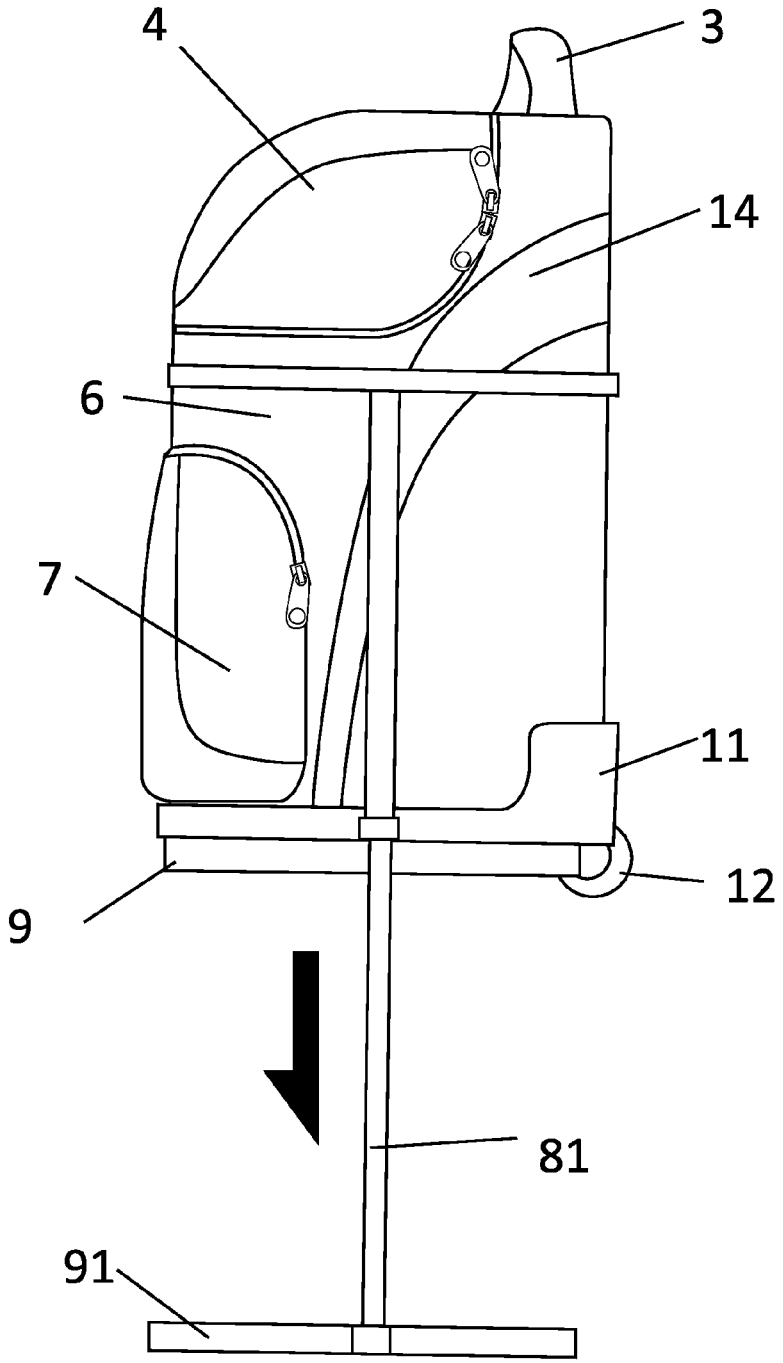
FIG. 8 is a left perspective view of a tennis bag with the stand extended of the tennis bag with tennis ball retrieving and dispensing unit in FIG. 1.

FIG. 8 is a left perspective view of the tennis bag 20 with the stand 25 extended of the tennis bag 20 with tennis ball 16 retrieving unit in FIG. 1

Figure 9:
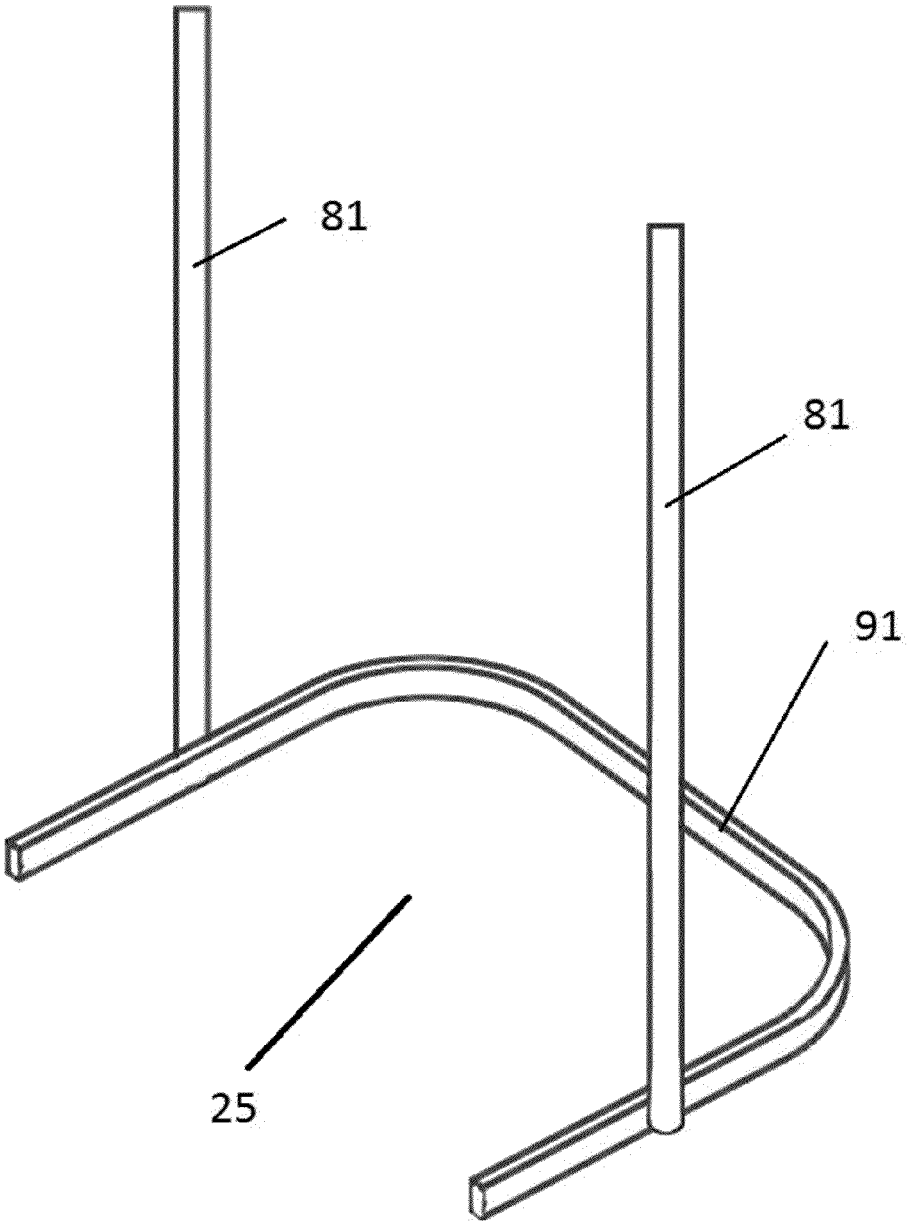
FIG. 9 is a plan view of a bottom part of the stand of the tennis bag with tennis ball retrieving and dispensing unit in FIG. 1.

FIG. 9 is a plan view of the bottom part of the stand 25 of the tennis bag 20 with tennis ball 16 retrieving unit in FIG. 1

Figure 10:
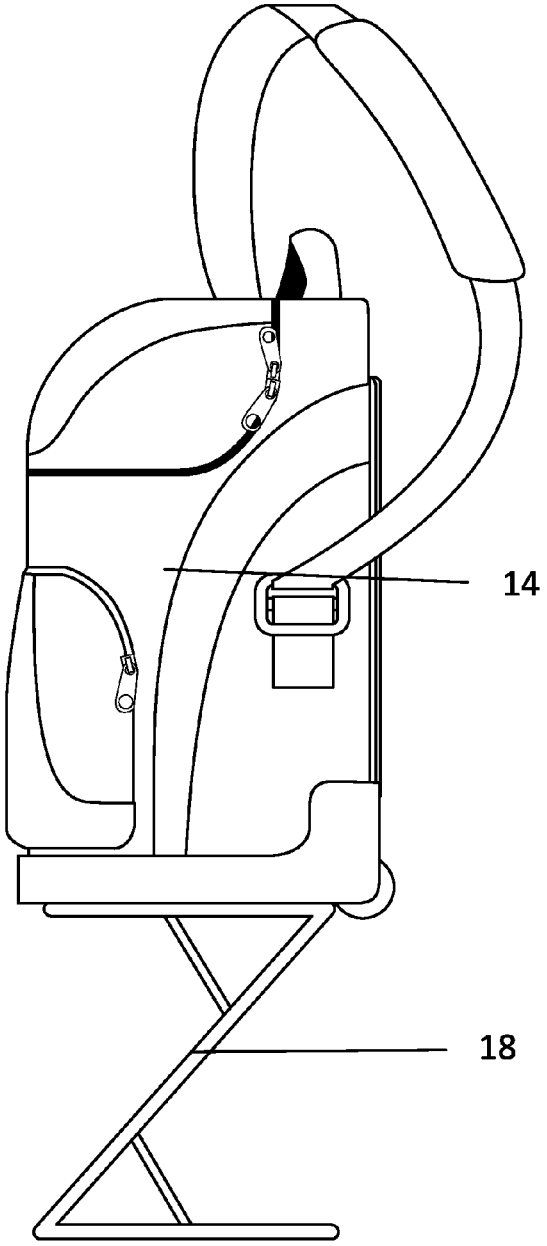
FIG. 10 is a left partial view of an alternative stand (detached) in extended position, and the tennis bag sitting on top of the stand, of the tennis bag with tennis ball retrieving and dispensing unit in FIG. 1.

FIG. 10 is a left partial view of an alternative stand (detached) in extended position, with the tennis bag 20 sitting on top of the stand 25, of the tennis bag 20 with tennis ball 16 retrieving unit in FIG. 1.

Figure 11:
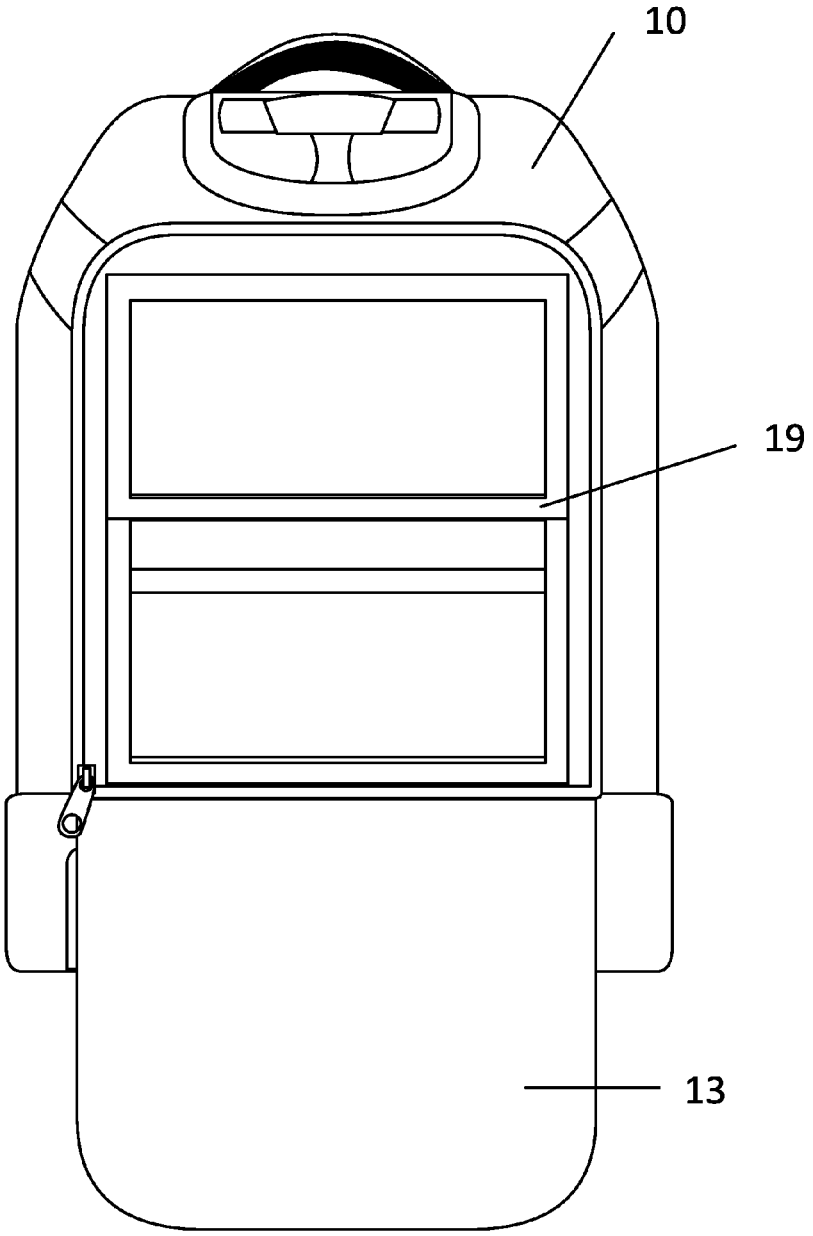
FIG. 11 is a rear partial view of a storage of the alternative stand (same as in FIG. 10) of the tennis bag 20 with tennis ball 16 retrieving and dispensing unit in FIG. 1.

FIG. 11 is a rear partial view of the storage of the alternative stand (same as in FIG. 10) of the tennis bag 20 with tennis ball 16 retrieving unit in FIG. 1

Figure 12:
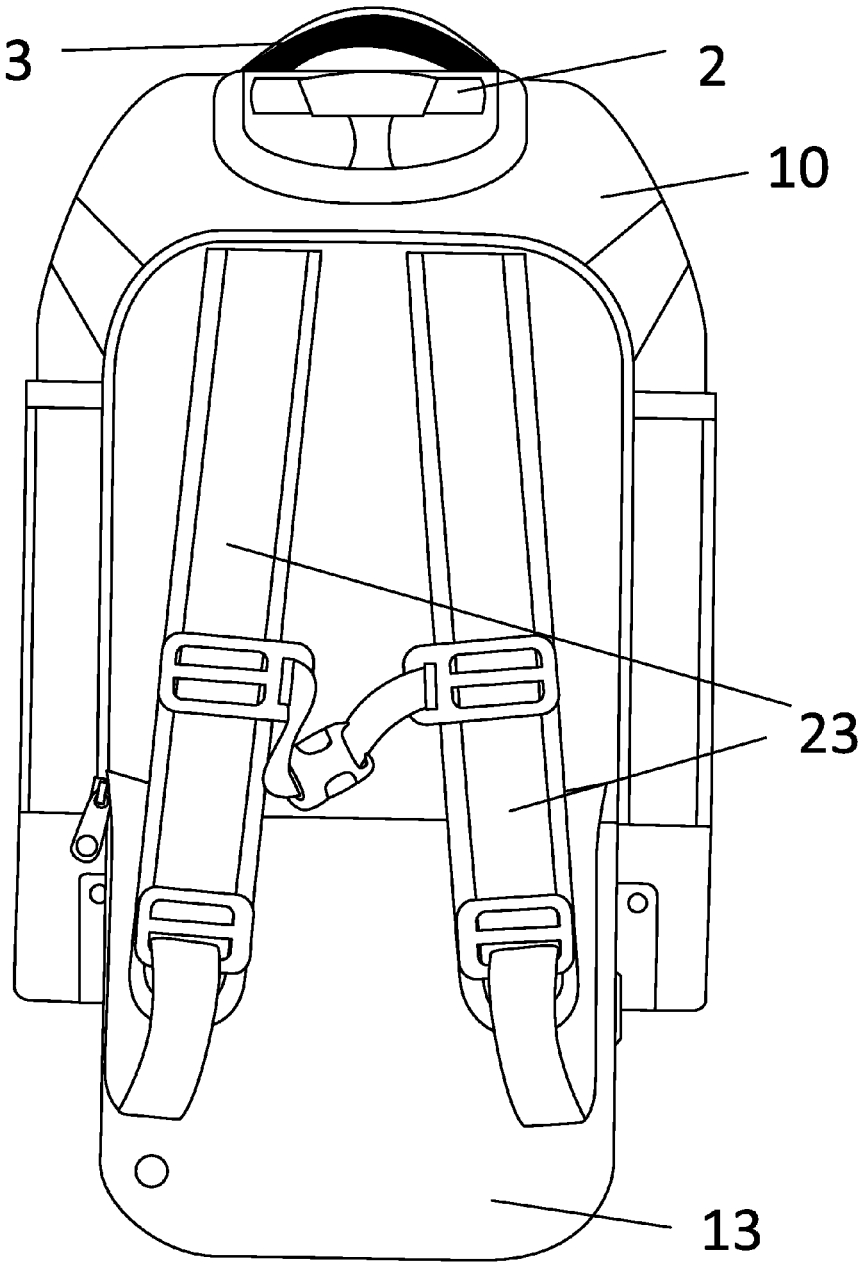
FIG. 12 is a rear elevation view of a shoulder strap 23 exposed when the pocket cover the shoulder strap 23 is unzipped of the tennis bag with tennis ball retrieving and dispensing unit in FIG. 1.
Figure 13:
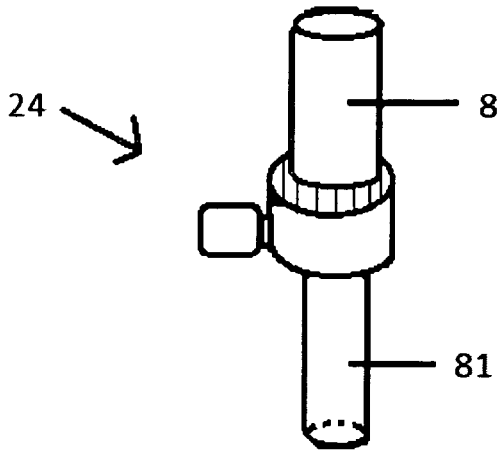
FIG. 13 is an exploded view of a lock 24 of side bars of the stand 25 of the tennis bag 20 with tennis ball retrieving unit in FIG. 1.

FIG. 12 is a rear elevation view of the shoulder strap 23 exposed when the pocket cover the shoulder strap 23 is unzipped FIG. 13 is an exploded view of the lock 24 of side bars of the stand 25 of the tennis bag 20 with tennis ball 16 retrieving unit in FIG. 1

FIG. 1 is a sketch illustration of the perspective view of the tennis bag 20 with tennis ball 16 retrieving unit. The details of the apparatus is not revealed in this figure, but will be described in the following figures.

FIG. 2 is the front view 6 of the tennis bag 20 with tennis ball 16 retrieving unit, that shows the tennis bag 20; the stretchable back bar 1 in its stretched position; end hand-grip 2 at the top end of stretchable back bar 1, and the stand 25.

The tennis bag 20 may be made of durable, light-weighted and water prove fabric or similar materials. The bottom panel 9 of the bag is the embodiment of the tennis ball 16 retrieving unit (not showing in this picture). The bag has the capacity of storing at least 50 balls. There is a zipper 21 at the upper part of the bag where the player can unzip the zipper 21 to open the top zippered flap 4, and reach inside of the tennis bag 20, then take out of retrieved tennis balls to play again.

FIG. 2 also shows the stand 25 in its original position during transportation or ball retrieving mode. The stand 25 is comprised of top panel bar 5 and bottom panel 9 bar of the stand 25; side-bar 8 of the stand 25 connect the top panel bar 5 of the stand 25 and the bottom panel 9 bar of the stand 25.

The stretchable back bar 1 is made of light-weighted rigid material, such as metal or glass-fiber, or any other material with the similar quality. The end hand-grip 2 is made of semi-rigid, light-weighted material, such as plastic, in a shape of easy grip with hand. The end hand-grip 2 and stretchable back bar 1 are to ease the transportation of the unit on ground when it is at its stretched position. The player can grip the end hand-grip 2, then gear and push the unit on the ground. When it is in its original position, i.e. unstretched position, the player can carry the unit by top hand strap 3 or shoulder strap 23.

There is an additional pocket 7 (or more additional pockets) for convenience of carrying more stuff or accessories.

FIG. 3 is the rear view of the tennis bag 20 with tennis retrieving unit, that shows the rolling means 12, the stretchable back bar 1 in stretched position, and the pocket cover 13 of shoulder strap 23 in zipped or closed position.

The rolling means 12 can be wheels, and are for transporting the unit on the ground. The rolling means 12 are designed to rotate up to 360 degree, so that the unit can be easily moved to any direction.

Under the pocket cover 13 of shoulder strap 23 are the shoulder straps 23. When the cover 13 is closed, it prevents the shoulder straps 23 get in the way of players, such as during ground transportation, or during game play, or any, other situations when shoulder straps 23 are not needed. When the cover 13 is unzipped or opened, the player can carry the unit by shoulders (not shown in FIG. 3).

FIG. 4 is the bottom view of the tennis bag 20 with tennis ball 16 retrieving unit, that shows the means of tennis ball 16 retrieving, such as during and after a tennis game. It shows a tennis ball 16 is slightly compressed in between the rigid grid bars 15, on its way from ground to be pushed into the bag 20 when forward then downward pressure applied to the bag end hand-grip 2 by the player, as will be described in FIG. 6.

FIG. 5 is a sketch of tennis ball 16 retrieving mean, comprised of a hand grip and a vertical bar (i.e. the end hand-grip 2 and the stretchable back bar 1), a short side-stick 17 molded to between the front of near bottom of the stretchable back bar 1 and the mid-portion of the rear bar of the grid 15 in the bottom panel 9.

The side stick 17 is to assist in keeping the ball retrieving frame 9 and the stretchable back bar 1 in a pre-determined and fixed angle during the ball retrieving process, and also to save energy of the player when applying forward and downward pressure against ball 16.

It also shows a tennis ball 16 is slightly compressed in between the rigid grid bars 15, on its way from ground to be pushed into the bag 20.

FIG. 6 is another sketch of tennis ball 16 retrieving mean, demonstrating the mechanism of action when the tennis ball 16 retrieving frame is on top of a tennis ball 16, the end hand-grip 2 is pushed forward then downward, forcing the ball to be compressed in between the grid bars 15 into the tennis bag 20. Solid lines demonstrate the mean in a neutral position. Dotted lines demonstrate the position of mean when forward and downward pressure is applied to.

FIG. 7 is the sketch of bottom panel 9, either oval or rectangle shape. There are multiple parallel grid bars 15 (either horizontal or vertical in relation to the longer outer sides 9, 11 of the panel), The bars 15 are directly or indirectly fixed to the outer sides 9, 11 of the bottom panel 9. The distance between the bars 15, or between bar 15 and outer sides 9, 11 of panel is slightly smaller than the diameter of a tennis ball 16, such width as to prevent the balls falling out from the bag 20 once retrieved in.

The bottom panel 9 is made of rigid, durable, light-weighted material, such as metal, or fiber glass, or any other material with the similar quality.

FIG. 8 is a left perspective view of a tennis bag 20 with tennis ball 16 retrieving unit, when the stand 25 is in use, i.e. in extended position. The stand 25 is comprised of a top panel 5, side bars or rods 8, and bottom panel 9. The top panel 5 is circumferential in shape and perpendicular in relation to the longitudinal axis of the tennis bag 20, positioned at about mid-level of the tennis bag 20. The side bars 8 are located on both left and right side of the bag 20 between about midway of top 5 and bottom 9 panels. The side bars 8 connect and fix the distance between top 5 and bottom 9 panels. There is a lock 24 on either side of the side bars 8 that secures the bars 8, 81 in place when in original position (i.e. not in use). When the lock 24 is open, it allows the bottom parts 81, 91 of the stand 25 automatically drops out by gravity, then re-lock the lock 24 to secure the bars 8, 81 in extended position.

When it is time to dispense or serve the ball, the player will unlock the lock 24 to let the bottom parts 81, 91 of the stand 25 drops out until it reaches desirable height, then the player will re-lock the lock 24. When it is time to have the bag on ground level, the player will unlock the lock 24 and the bag 20 will drop automatically to the ground level, and the player will then re-lock the lock 24 to secure it in its original position.

The stand 25 is comprised of small caliber tubes made of light-weighted metal, or durable rigid fiber glass, or any other material with similar quality. The bottom side bars 81 are slightly smaller in diameter than the top side bar 8, so the bottom side bar 81 can be inserted into the top side bar 8 (original position) when not in use (i.e. not in extended position).

FIG. 9 is a plan illustration of the bottom part of the stand 25 when it is pulled out of the top part of stand 25, shows the bottom side bars 81 and the U-shaped bottom panel 91 for stabilization of the unit when set on ground.

FIG. 10 shows an alternative option 18 of the stand 25, which is detached from the bag 20, at an extended mode and in use. The tennis bag 20 unit sits on top of the stand 25. The height of the stand 25 can be adjusted to the desired level by the player.

The alternative stand 18 is comprised of small caliber tubes or narrow linear plate, made of light-weighted metal, or durable rigid fiber glass, or any other material with similar quality.

FIG. 11 is the same stand 18 as in FIG. 10, but is in a folded mode 19 when not in use, which is easily stored in the back pocket of the bag.

FIG. 12 is the elevated rear view of the tennis bag 20 with tennis retrieving unit, that is similar to FIG. 3, except the pocket cover 13 of the shoulder strap 23 is unzipped or open, showing the shoulder straps 23 are exposed, and can be used to carry the unit by shoulders.

FIG. 13 is the exploded view of the lock 24 on either side of the side bars 8. The actual design of the lock 24 may change. The lock 24 is located at the lower end of the top side bar 8 and is made of durable and rigid plastic material or similar material.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims:

What is claimed is:

1. A tennis bag comprising:

a ball retrieving and dispensing unit for storing and transporting tennis balls;

a stretchable back bar;

an end hand-grip rigidly connected to the stretchable back bar;

a stand having side components;

a bottom panel having a ball retrieving grid;

means for pushing the stretchable back bar to retrieve the tennis balls and for rolling the tennis bag on a ground;

means for hand-gripping the end hand-grip to press the stretchable back bar, and to gear a direction of a motion of the tennis bag;

means for carrying the tennis bag by one hand of a user;

means for preventing the tennis balls falling out when the tennis bag is sealed; and for the user to reach the tennis balls inside the tennis bag to dispense during a game play when the tennis bag is opened;

means for having a top panel bar in the stand;

means for having a front cover;

means for raising the tennis bag to a higher level by extending the side components of the stand;

means for connecting the ball retrieving grid to a bottom part of the stand;

means for connecting a rear cover to the stretchable back bar;

means for having a plate at a rear bottom portion of the tennis bag;

means for transportation of the tennis bag and for tracing the tennis balls on the ground;

means for having a left side cover;

means for connecting the ball retrieving grid to the plate;

means for stabilizing and leveling the stand when the side components of the stand is in an extended position;

means for easily storing an other stand in the tennis bag when the other stand is folded;

means for raising the tennis bag to an other higher level when the other stand is in an extended position;

means for storing and transporting the tennis balls;

means for the user to pick up the tennis balls;

means for containing and sealing shoulder straps when the shoulder straps are not in use;

means for carrying the tennis bag over shoulders of the user;

means for keeping the ball retrieving grid and the stretchable back bar at a pre-determined angle;

means for securing the stand in the extended position and in an un-extended position; and means for raising the tennis bag for ball dispensing.

2. The tennis bag of claim 1, wherein the stretchable back bar is a hollow tube made of a lightweight metal.

3. The tennis bag of claim 1, wherein the end hand-grip is of a rounded shape.

4. The tennis bag of claim 1, wherein said means for carrying the tennis bag by one hand of the user comprises of using a fabric top hand strap.

5. The tennis bag of claim 1, wherein said means for preventing the tennis balls falling out when the tennis bag is sealed; and for the user to reach the tennis balls inside the tennis bag to dispense during the game play when the tennis bag is opened comprises of using a fabric, waterproof top zipped flap having a zipper at an edge.

6. The tennis bag of claim 1, wherein the top panel bar of the stand is made of a rigid, lightweight material.

7. The tennis bag of claim 1, wherein the front cover is made of a fabric, waterproof, durable material.

8. The tennis bag of claim 1, wherein the side components of the stand comprise rigid, lightweight side-bars.

9. The tennis bag of claim 1, wherein the ball retrieving grid is made of a rigid, lightweight material.

10. The tennis bag of claim 1, wherein the rear cover is made of a fabric, semi-sturdy, waterproof material.

11. The tennis bag of claim 1, wherein the plate is made of a sturdy, lightweight material.

12. The tennis bag of claim 1, further comprising rollers to facilitate the transportation of the tennis bag and the tracing of the tennis balls on the ground.

13. The tennis bag of claim 1, wherein the left side cover is made of a fabric, lightweight, waterproof material.

14. The tennis bag of claim 1, wherein the ball retrieving grid comprises rounded, lightweight, metal bars.

15. The tennis bag of claim 1, wherein the side components of the stand comprise metal side-bars of tube shapes.

16. The tennis bag of claim 1, wherein the stand further has a metal bottom bar of a tube shape.

17. The tennis bag of claim 1, wherein the tennis bag is foldable.

18. The tennis bag of claim 1, wherein the stand is sturdy.

19. The tennis bag of claim 1, wherein the tennis bag is made of a lightweight, waterproof, soft, durable material.

20. The tennis bag of claim 1 further comprising a front zipper for the user to unzip the front zipper to pick up the tennis balls.

21. The tennis bag of claim 1 further comprising a fabric, waterproof pocket to cover the shoulder straps.

22. The tennis bag of claim 1, wherein the shoulder straps are made of a fabric, waterproof, durable materials.

23. The tennis bag of claim 1 further comprising a rigid, lightweight side stick to keep the ball retrieving grid and the stretchable back bar at the pre-determined angle.

24. The tennis bag of claim 1, wherein the side components of the stand comprise metal side-bars of tube shapes and wherein the metal side-bars have locks to secure the stand in the extended and the un-extended positions.

25. The tennis bag of claim 1, wherein the stand is made of a sturdy, lightweight material.

26. A tennis bag comprising:

a ball retrieving and dispensing unit for storing and transporting tennis balls;

a lightweight, metal, hollow tube stretchable back bar being pushed to retrieve the tennis balls and to roll the bag on a ground;

a rounded end hand-grip connected to said stretchable back bar;

a fabric top hand strap for carrying the tennis bag by one hand of a user;

a fabric, waterproof top zipped flap having a zipper on an edge;

a stand having a rigid, lightweight, top panel bar, rigid, lightweight side-bars with locks, and a metal bottom bar, the side-bars being extendable;

a fabric, waterproof, durable front cover;

a rigid, lightweight, bottom panel having a ball retrieving grid, the ball retrieving grid comprising rounded, lightweight, metal bars;

a fabric, semi-sturdy, waterproof rear cover rigidly connected to said stretchable back bar;

a sturdy, lightweight plate at a rear bottom portion of the tennis bag;

rollers;

a fabric, lightweight, waterproof left side cover;

an other stand that is foldable;

a front zipper;

shoulder straps;

a fabric, waterproof pocket to cover the shoulder straps when the shoulder straps are not in use; and a rigid, lightweight side stick for keeping the ball retrieving grid and the stretchable back bar at a pre-determined angle;

wherein the stand is characterized by:

an extended position in which the side-bars are extended and the tennis bag is raised to a higher level; and an un-extended position in which the side-bars are not extended.

27. The tennis bag of claim 26, further comprising:

another fabric, waterproof pocket for additional storage space.

28. A tennis bag comprising:

a ball retrieving and dispensing unit for storing and transporting tennis balls;

a lightweight, metal, hollow tube stretchable back bar being pushed to retrieve the tennis balls and to roll the bag on a ground;

a rounded end hand-grip, connected to said stretchable back bar;

a fabric top hand strap for carrying the tennis bag by one hand of a user;

a fabric, waterproof top zipped flap having a zipper on an edge;

a stand having a rigid, lightweight top panel bar, rigid, lightweight side-bars with locks, and a metal bottom bar, the side-bars being extendable;

a fabric, waterproof, durable front cover;

a rigid, lightweight bottom panel having a ball retrieving grid, the ball retrieving grid comprising rounded, lightweight, metal bars;

a fabric, semi-sturdy, waterproof rear cover rigidly connected to said stretchable back bar;

a sturdy, lightweight plate at a rear bottom portion of the tennis bag;

rollers;

a fabric, lightweight, waterproof left side cover;

an other stand that is foldable;

a front zipper;

shoulder straps;

a fabric, waterproof pocket to cover the shoulder straps when the shoulder straps are not in use;

another fabric, waterproof pocket for additional storage space; and a rigid, lightweight side stick, for keeping the ball retrieving grid and the stretchable back bar at a pre-determined angle;

wherein the stand is characterized by:

an extended position in which the side-bars are extended and the tennis bag is raised to a higher level; and an un-extended position in which the side-bars are not extended.

* * * * *